US008037826B2

(12) United States Patent
Taylor

(10) Patent No.: US 8,037,826 B2
(45) Date of Patent: Oct. 18, 2011

(54) MECHANICAL SELF DESTRUCT FOR RUNAWAY ESCAPEMENTS

(75) Inventor: Norman C. Taylor, Davenport, FL (US)

(73) Assignee: DSE, Inc., Tampa, FL (US)

( * ) Notice: Subject to any disclaimer, the term of this patent is extended or adjusted under 35 U.S.C. 154(b) by 902 days.

(21) Appl. No.: 11/809,735

(22) Filed: Jun. 1, 2007

(65) Prior Publication Data

US 2011/0000388 A1 Jan. 6, 2011

Related U.S. Application Data

(60) Provisional application No. 60/803,710, filed on Jun. 1, 2006.

(51) Int. Cl.
*F42C 15/22* (2006.01)

(52) U.S. Cl. ..... 102/237; 102/426; 102/222; 102/229; 102/231

(58) Field of Classification Search ..... 102/237, 102/426, 221, 222, 229–231, 235, 236, 239–242, 102/244–246, 254–256; 89/1.55, 6
See application file for complete search history.

(56) References Cited

U.S. PATENT DOCUMENTS

| | | | | |
|---|---|---|---|---|
| 2,458,474 | A | | 1/1949 | Jordan |
| 2,644,398 | A | | 7/1953 | Rabinow |
| 2,663,260 | A | | 12/1953 | Thompson |
| 2,790,390 | A | | 4/1957 | Baker |
| 2,921,524 | A | | 1/1960 | Rabinow |
| 3,450,047 | A | | 6/1969 | Piskorski |
| 3,734,023 | A | | 5/1973 | Kaiser et al. |
| 3,786,759 | A | | 1/1974 | Mellen et al. |
| 3,848,531 | A | | 11/1974 | Mellen |
| 3,871,298 | A | | 3/1975 | Popovitch et al. |
| 3,910,193 | A | | 10/1975 | Shelley et al. |
| 3,949,675 | A | | 4/1976 | Luke |
| 3,985,079 | A | | 10/1976 | Post et al. |
| 4,004,521 | A | | 1/1977 | Andrejkovics |
| 4,018,164 | A | | 4/1977 | Breed et al. |
| 4,029,016 | A | | 6/1977 | Cole |
| 4,213,395 | A | | 7/1980 | Breed |
| 4,242,963 | A | | 1/1981 | Ziemba |
| 4,449,455 | A | | 5/1984 | Halssig |
| 4,470,351 | A | | 9/1984 | Farace |
| 4,599,945 | A | * | 7/1986 | Groustra et al. ..... 102/256 |
| H000124 | H | * | 9/1986 | Antonuzzi et al. ..... 102/254 |
| 4,969,397 | A | | 11/1990 | Gunther et al. |
| 5,063,847 | A | * | 11/1991 | Halssig et al. ..... 102/271 |
| 5,440,992 | A | * | 8/1995 | Chemiere et al. ..... 102/246 |
| 6,035,783 | A | | 3/2000 | Cho |
| 6,145,439 | A | | 11/2000 | Ziemba |
| 6,237,495 | B1 | | 5/2001 | Hok et al. |
| 7,168,367 | B2 | * | 1/2007 | Levy et al. ..... 102/489 |
| 7,258,068 | B2 | * | 8/2007 | Worthington ..... 102/256 |
| 2007/0051266 | A1 | | 3/2007 | Zinell et al. |

* cited by examiner

*Primary Examiner* — Michelle Clement
(74) *Attorney, Agent, or Firm* — Ronald E. Smith; Smith & Hopen, P.A.

(57) ABSTRACT

An escapement fuze self-destruct mechanism for a projectile includes a drive weight that maintains a biasing member in a compressed state by centrifugal force when a projectile's RPM speed is above a preselected threshold. When the RPM speed falls below the preselected threshold, the biasing member exerts sufficient counter-rotational force to overcome the centrifugal force exerted by the drive weight. The biasing member expands to an uncompressed state and displaces the drive weight into position for mechanically implementing self-destruction of the projectile if a rotor is fully armed or for rendering the projectile "safe" if the rotor is in any position other then fully armed.

6 Claims, 4 Drawing Sheets

MECHANICAL SELF DESTRUCT FOR RUNAWAY ESCAPEMENTS

FIELD OF INVENTION

This invention relates to self destruct mechanisms for munitions. More particularly, it relates to a self destruct mechanism for runaway escapements.

BACKGROUND OF THE INVENTION

When conventional ammunition is fired, pressure is generated by a propellant that burns in a high-pressure chamber. The pressure forces expanding gases to flow through vent holes into a low-pressure chamber and propels a projectile from the high-pressure chamber. A rotating band around the projectile engages rifling in a launcher tube thereby generating a high RPM spin to the projectile. Upon firing, setback force causes the fuze setback pin to move away from the fuze rotor. The rotor is held out of line with a fuze detonator by the setback pin and a fuze centrifugal lock that engages gear teeth of the fuze rotor.

When the projectile attains sufficient spin, the centrifugal lock releases the rotor and arming begins. The rotor begins rotation toward the center of the projectile. The rotor gear, when engaged with the pinion shaft, delays arming of the fuze. After the projectile has traveled an acceptable distance from the launcher tube, the rotor is locked in the armed position and the fuze is armed.

However, a significant problem exists in conventional runaway escapements. A self-destruct mechanism is needed for runaway escapement fuzes. The mechanism should be inexpensive and small in size but is should possess high efficacy.

U.S. Pat. No. 6,141,080 discloses an apparatus mountable in a projectile for utilization with a rotor-type safing and arming mechanism for post-launch self-neutralization of a spinning projectile having a fused warhead and a stab detonator. That apparatus relies on a launch-activated battery, however, and an electric detonator positioned sufficiently close to the stab detonator to initiate the stab detonator upon initiation of the electric detonator. It further includes a spin decay switch circuit operatively interconnecting a charged storage capacitor and the electric detonator upon substantial cessation of projectile spin, for delivering power sufficient to initiate the electric detonator. The apparatus includes a storage capacitor charging circuit activated by launch-induced forces. It further includes a pre-launch shorting circuit electrically connected in parallel with the electric detonator and deactivated by launch forces, and a "bleed" circuit connected in parallel with the battery activated by launch-induced forces.

There is a need, therefore, for a post-launch self-neutralization safe and arm mechanism that does not rely upon a battery that is activated by launch-induced forces, a battery-reliant electric detonator, a spin delay switch circuit, a storage capacitor, a storage capacitor charging circuit, a pre-launch shorting circuit, a bleed circuit and other such electrical components.

SUMMARY OF INVENTION

The long-standing but heretofore unfulfilled need for a low cost, small in size, yet highly reliable escapement fuze self-destruct mechanism for a projectile is now met by a new, useful, and nonobvious invention.

The novel apparatus includes a pivotally mounted drive weight that maintains a bias member in a compressed state by centrifugal force as long as a projectile's RPM speed is at an acceptable level. When the RPM falls below the acceptable level, the bias member exerts sufficient counter-rotational force to overcome the centrifugal force exerted by the drive weight. The drive weight therefore pivots into a position that releases a retainer for a firing pin and the firing pin detonates a stab detonator that causes self-destruction of the projectile if the rotor is in a fully armed configuration. The projectile is rendered "safe" if the rotor is unarmed, i.e., if the rotor is in any configuration other than its fully armed configuration.

More particularly, the novel mechanical escapement fuze self-destruct device is attached to a projectile and includes a rotor, a firing pin and a firing pin drive spring mounted on the rotor. The firing pin drive spring is compressed and the firing pin is retracted when the projectile is rotating at an RPM associated with its maximum range. The firing pin drive spring is uncompressed and the firing pin is extended when the projectile is rotating at an RPM less than the RPM associated with its maximum range.

A stab detonator is detonated when the firing pin is extended and such detonation causes self-destruction of the projectile if the rotor is fully armed and the projectile is rendered safe if the rotor is not fully armed.

A retainer has a first retainer position for holding the firing pin drive spring and hence the firing pin in a compressed, loaded, energy storing configuration and has a second retainer position for releasing the firing pin drive spring and hence the firing pin so that the firing pin can strike the stab detonator.

A release lever has a first release lever position for holding the retainer in the first retainer position and has a second release lever position for releasing the retainer.

A drive weight is pivotally mounted to the rotor. A drive weight bias means urges the drive weight to pivot in a first direction. The drive weight is adapted to bear against the release lever and to maintain the release lever in the first release lever position when the rotor is not rotating.

A setback pin is adapted to engage the drive weight and to prevent rotation of the drive weight when the rotor is not rotating. The setback pin is adapted to release the drive weight and to enable rotation of the drive weight when the projectile is fired.

The drive weight is adapted to pivot in a second direction, opposite to the first direction, when subjected to centrifugal force arising from rotation of the projectile caused by firing of the projectile.

The drive weight bias means has a preselected spring constant insufficient to rotate the drive weight in the first direction when the centrifugal force is equal to a maximum centrifugal force arising from maximum range rotation of the projectile.

The preselected spring constant is sufficient to rotate the drive weight in the first direction when the centrifugal force is less than the maximum centrifugal force.

The drive weight pivots in the first direction when rotation of the projectile is less than the maximum range rotation. The drive weight therefore bears against the release lever and causes the release lever to pivot into its release position. The firing pin drive spring and hence the firing pin are released when the release lever pivots into said release position, and the firing pin is driven into the stab detonator which explosively detonates and destroys the projectile if the rotor is armed and which renders the projectile "safe" if the rotor is unarmed.

An important object of the invention is to provide a self-destruct mechanism that is entirely mechanical and free of electrical elements.

Another important object is to provide a self-destruct mechanism that is activated when centrifugal forces acting on the mechanism fall below a preselected threshold, thereby avoiding false activations that may be caused by electrical components.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

The novel method includes the steps of striking the side of a stab detonator in a runaway escapement with a firing pin. The firing pin is displaced when a bias member such as a spring under compression is released when the RPM of the round becomes less than that at full range. The warhead goes high order if the rotor is in the armed position. The warhead does not go high order if the rotor is in any position other than its fully armed position.

If the rotor is in any position other than armed, the detonator is fired and hence the round is classified as safe. This is because the rotor, when in any position other than fully armed, prevents the detonator from aligning with a spit back in projectiles having spit backs, and prevents the detonator from aligning with the primary charge/warhead in those projectiles lacking spit backs. If a detonator detonates when it is misaligned with a spit back or misaligned with a primary charge, the primary charge cannot explode. However, after the detonator has detonated, the projectile is safe to handle even though its primary charge remains unexploded. It cannot explode with a detonator that has already been detonated, even if it is dropped or otherwise handled roughly.

FIGS. 1-5 depict the novel structure in the context of a M550 escapement for illustrative purposes.

Figure 1:
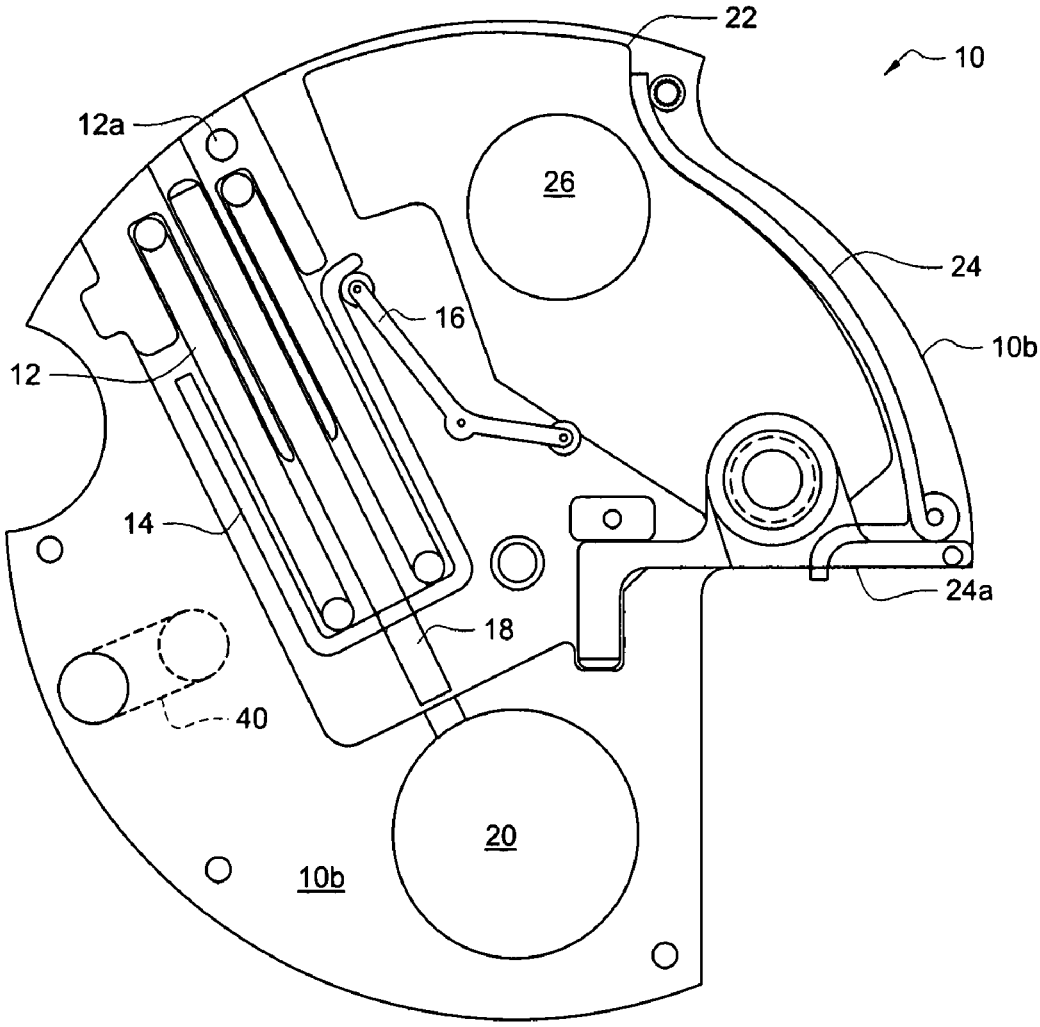
FIG. 1 is a plan view of an illustrative embodiment of the novel rotor when in a safe configuration and with the top plate of the rotor removed.
Figure 2:
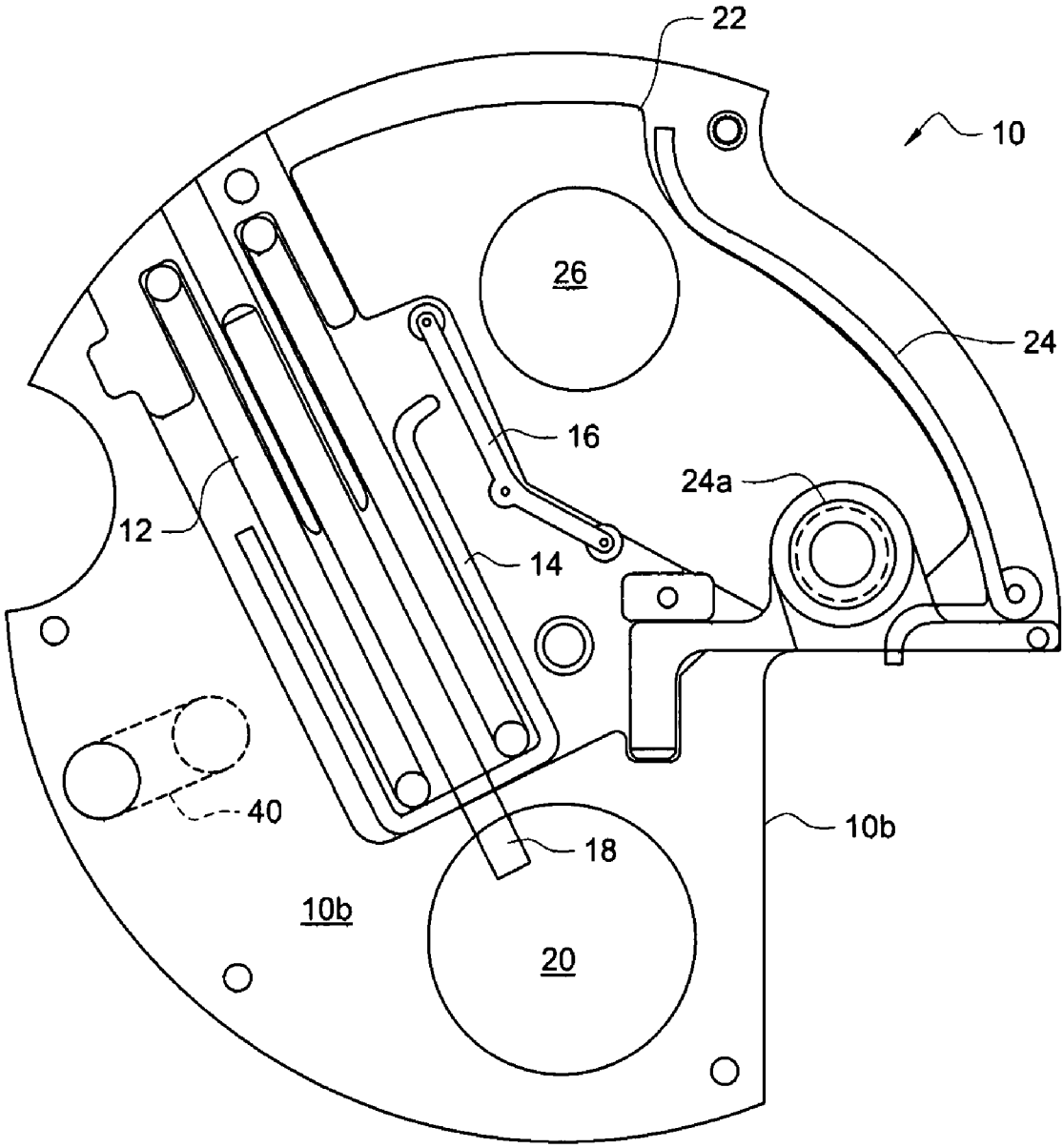
FIG. 2 is a plan view of the novel rotor when in a detonate configuration.

Rotor 10 is depicted in FIGS. 1 and 2 with top plate 10*a* removed. includes firing pin drive spring 12, depicted in FIG. 1 in its compressed or loaded, energy-storing configuration. Spring bushing 12 reduces friction and wear on said spring 12. Expansion of said drive spring is prevented by cup-shaped retainer 14 which is held in its FIG. 1 position by pivotally mounted release lever 16 when said release lever is in its first or locked position. Firing pin 18 is depicted in FIG. 1 in its safe position. When release lever 16 is pivoted away from said first, locked position into a second, unlocked position, retainer drive spring 12 unloads, converting potential energy into kinetic energy, and drives firing pin 18 into stab detonator 20. Stab detonator 20 therefore explosively detonates and destroys the projectile if the rotor is in the armed position. If the rotor is in any other position, such detonation renders the projectile safe.

Pivotally mounted drive weight 22 bears against release lever 16 and holds said release lever in its locked position when said drive weight is in its position of repose. Drive spring 24 urges drive weight 22 to pivot in a counterclockwise direction as drawn in FIG. 1, thereby ensuring that drive weight 22 bears against release lever 16 to maintain retainer 14 and hence firing pin 18 in its safe position. Drive spring weight bushing 24*a* is a cylindrical lining designed to reduce friction and wear as drive weight 22 pivots about said bushing.

Setback pin 26, indicated generically in FIG. 1, holds drive weight 22 in said position of repose, resisting the rotational force supplied by drive spring 24, even if the round is subjected to strong vibrations, five foot drops, and the like as required in safety tests.

Figure 5:
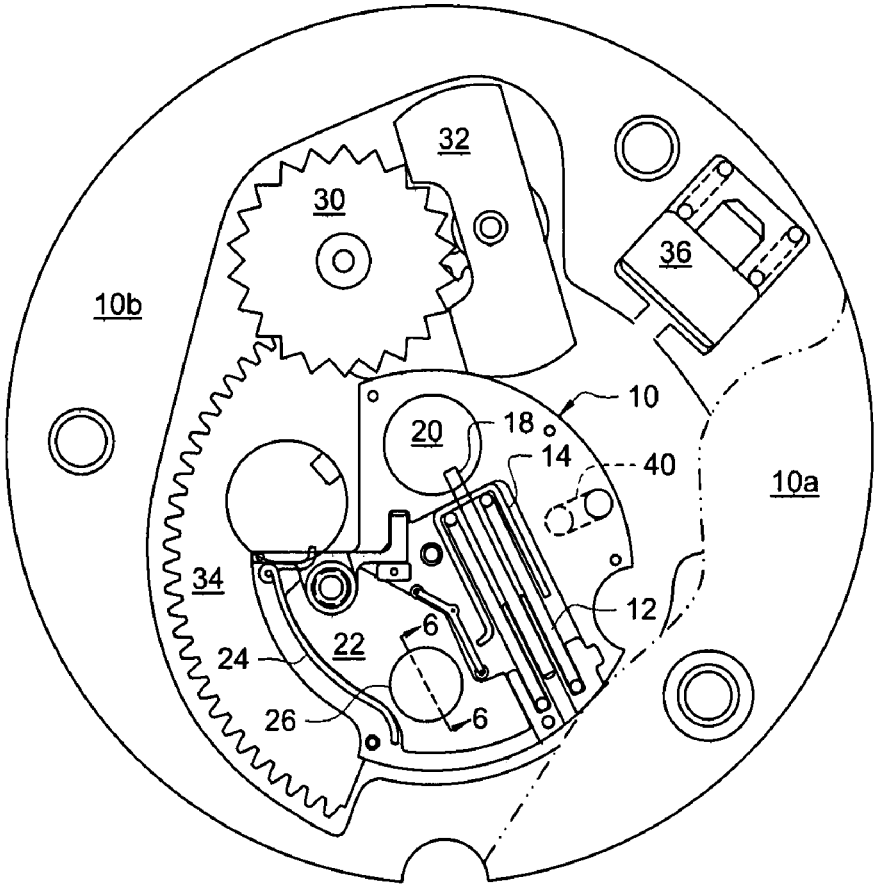
FIG. 5 is a plan view of the novel rotor in a "detonate in armed position" within a conventional M550 assembly.

When a round is fired, setback pin 26 is driven aft as depicted in FIG. 5. This unlocks drive weight 22 so that the drive weight is free to rotate in a counterclockwise direction under the bias of drive spring 24. However, centrifugal force created by the revolutions of the round act on drive weight 22 and hold drive weight 22 in its safe, unrotated position of repose. When the centrifugal force drops below a predetermined threshold as the revolutions per unit time of the round decrease, the bias of drive spring 24 exceeds the centrifugal force and drive weight 22 rotates in a counterclockwise direction under said bias. The threshold RPM of the round is reached when the RPMs drop below the maximum range RPM of the round.

As depicted in FIG. 2, upon counterclockwise motion, drive weight 22 rotates release lever 16 in a clockwise direction which results in said release lever unlocking retainer 14, thereby permitting firing pin drive spring 12 to convert its stored potential energy into kinetic energy and to thereby drive firing pin 18 into the side of stab detonator 20. This results in explosive detonation of stab detonator 20 and destruction of the projectile if the rotor is in its fully armed position. If the rotor is in any position other than its fully armed position, explosive detonation of the stab detonator still occurs but the warhead will not explode and the projectile is rendered safe, i.e., it can be handled without fear of explosion.

Figure 3:
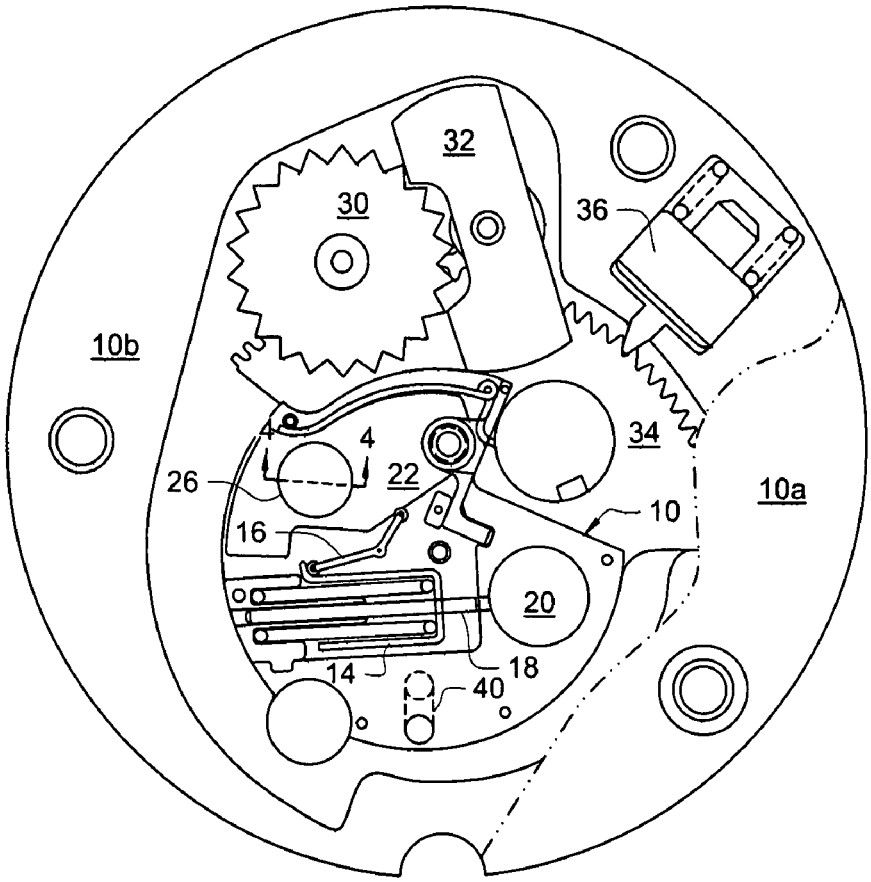
FIG. 3 is a plan view of the novel rotor in a safe configuration within a conventional M550 assembly.
Figure 4:
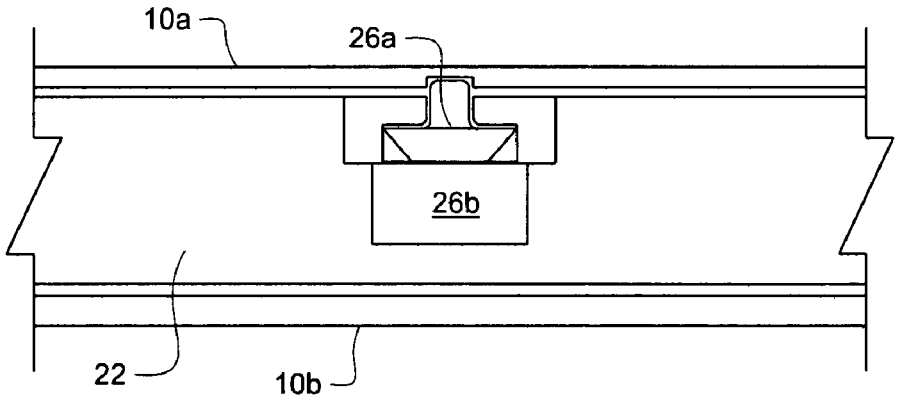
FIG. 4 is a sectional view taken along line 4-4 in FIG. 3.
Figure 6:
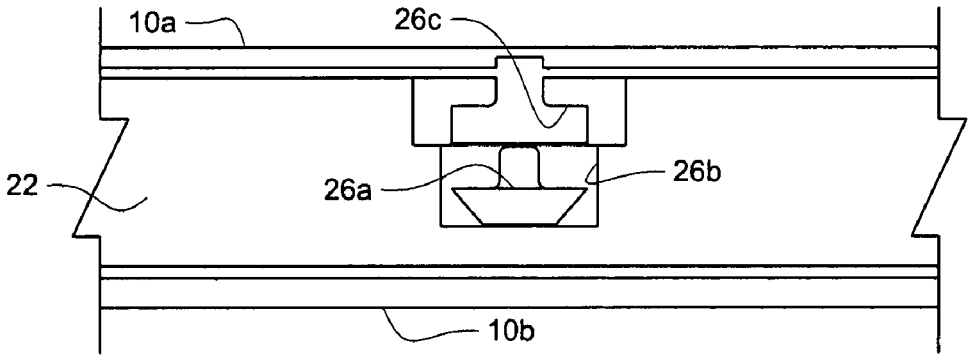
FIG. 6 is a sectional view taken along line 6-6 in FIG. 5.

FIGS. 3 and 5 depict the safe and fired positions of the rotor, respectively, in a complete S & A assembly having a conventional star wheel 30, verge 32, rotor 34 and firing pin 36. FIG. 4 depicts setback pin 26*a* in its extended, safe position where lower cavity 26*b* is empty and upper cavity 26*c* is occupied. FIG. 6 depicts setback pin 26*a* in its retracted position, occupying lower cavity 26*b*.

Rotor lock 40 mechanically locks rotor 10 in the armed position so that ground impact loads cannot drive the rotor from the armed position. This increases the probability of a high order detonation of the round. This concept can be used in any escapement.

The rotor is kept in the safe position by the centrifugal lock and set back pin, both of which are unlocked by gun launch. The rotor then takes about a tenth of a second or a little longer to arm. This has nothing to do with the rendered safe/self-destruct (RS/SD) subsystem disclosed herein. When a round reaches an RPM (revolutions per minute) associated with a distance beyond the maximum range of the round, the RS/SD mechanism releases the firing pin of the self-destruct mechanism. The firing pin then detonates the detonator in the rotor regardless of the position of the rotor, whether armed, safe, or partially armed. The detonator then fires the spit back and the round goes high order if the rotor has reached the fully armed position. There is never a guarantee that the rotor will reach the fully armed position. However, the novel assembly of parts disclosed herein does ensure that when a fired round reaches a sufficiently low RPM, the firing pin will fire and the detonator will detonate. Whether or not such detonation causes projectile detonation or renders the projectile safe depends upon the position of the rotor at the time the stab detonator detonates. If the stab detonator at the moment of detonation is aligned with a spit back, or aligned directly with a primary charge in projectiles lacking a spit back, the projectile will explode. If the stab detonator at the moment of detonation is not aligned with a spit back, or not aligned directly with a primary charge in projectiles lacking a spit back, the projectile will not explode but it will be rendered safe to handle because the primary charge cannot explode in the absence of an unfired detonator.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between.

What is claimed is:

1. A mechanical escapement fuze self-destruct device that is attached to a projectile that rotates about its axis of symmetry when in flight, comprising:

a rotor having an armed position where a stab detonator is aligned with a primary charge or a spitback and an unarmed position where the stab detonator is misaligned with said primary charge or said spitback;

said rotor being mounted in a hollow interior of said projectile and said rotor rotating conjointly with said projectile when said projectile rotates about said axis of symmetry;

a firing pin and a firing pin drive spring mounted on said rotor;

said firing pin drive spring being compressed and said firing pin being retracted when said projectile is rotating at an RPM associated with its maximum range;

said firing pin drive spring being uncompressed and said firing pin being extended when said projectile is rotating at an RPM less than said RPM associated with its maximum range;

said stab detonator being detonated when said firing pin is extended, said detonation causing self-destruction of said projectile if said rotor is in said armed position; and said detonation of said stab detonator rendering said projectile "safe" if said rotor is in said unarmed position because if said rotor enters into said armed position after detonation of said stab detonator, the primary charge or spitback cannot detonate due to the previous detonation of said stab detonator.

2. The device of claim 1, further comprising:

a retainer having a first retainer position for holding said firing pin drive spring in said compressed, loaded, energy storing configuration and having a second retainer position for releasing said firing pin drive spring so that said firing pin drive spring expands and unloads energy.

3. The device of claim 2, further comprising:

a release lever having a first release lever position for holding said retainer in said first retainer position and having a second release lever position for releasing said retainer.

4. The device of claim 3, further comprising:

a drive weight pivotally mounted to said rotor;

a drive weight spring for urging said drive weight to pivot in a first direction, said drive weight adapted to bear against said release lever and to maintain said release lever in said first release lever position when said rotor is not rotating.

5. The device of claim 4, further comprising:

a setback pin adapted to engage said drive weight and to prevent rotation of said drive weight when said rotor is not rotating;

said setback pin adapted to release said drive weight and to enable rotation of said drive weight when said projectile is fired.

6. The device of claim 5, further comprising:

said drive weight pivoting in a second direction, opposite to said first direction, when subjected to centrifugal force arising from rotation of said projectile caused by firing of said projectile;

said drive weight spring having a preselected spring constant insufficient to rotate said drive weight in said first direction when said centrifugal force is equal to a maximum centrifugal force arising from maximum range rotation of said projectile;

said drive weight spring rotating said drive weight in said first direction when said centrifugal force is less than said maximum centrifugal force;

said drive weight pivoting in said first direction when rotation of said projectile is less than said maximum range rotation;

said drive weight bearing against said release lever and causing said release lever to pivot into its release position when said drive weight is in said first position;

said retainer being released by said release lever pivoting into said release position;

said release of said retainer causing release of said firing pin drive spring;

said release of said firing pin drive spring firing pin driving said firing pin into said stab detonator and causing said stab detonator to detonate;

said detonation of said stab detonator causing detonation of said projectile if said stab detonator is aligned with said primary charge or spitback when said stab detonator detonates;

said detonation of said stab detonator causing no detonation of said projectile if said stab detonator is misaligned with said primary charge or spitback when said stab detonator detonates; and said detonation of said stab detector preventing subsequent detonation of said primary charge or spitback.

* * * * *